United States Patent [19]

Stubbings

[11] 4,183,239

[45] Jan. 15, 1980

[54] TWO-PIECE FASTENER AIR HAMMER

[75] Inventor: James H. Stubbings, Rockville, Md.

[73] Assignee: Potomac Applied Mechanics, Inc., Bethesda, Md.

[21] Appl. No.: 833,338

[22] Filed: Sep. 14, 1977

[51] Int. Cl.[2] ..... B21J 15/34

[52] U.S. Cl. ..... 72/391; 72/453.17; 85/84

[58] Field of Search ..... 72/391, 453.08, 453.17; 29/243.53, 243.54, 522, 509; 92/65; 85/81, 83, 84; 173/103; 227/147

[56] References Cited

U.S. PATENT DOCUMENTS

| | | | |
|---|---|---|---|
| 1,587,317 | 6/1926 | Horton | 85/84 |
| 3,032,771 | 5/1962 | Bisbing | 72/391 |
| 3,042,244 | 7/1962 | Van Hecke | 72/391 |
| 3,487,745 | 1/1970 | Brunelle | 29/522 |
| 3,691,924 | 9/1972 | Baker | 85/63 |
| 3,724,738 | 4/1973 | Hurst | 29/509 |
| 3,924,509 | 12/1975 | Alexandrer | 85/84 |
| 4,036,309 | 7/1977 | Petreev | 92/65 |

FOREIGN PATENT DOCUMENTS

| | | | |
|---|---|---|---|
| 2237889 | 2/1974 | Fed. Rep. of Germany | 29/243.53 |
| 2434131 | 1/1975 | Fed. Rep. of Germany . | |
| 2658336 | 7/1977 | Fed. Rep. of Germany . | |

*Primary Examiner*—Francis S. Husar
*Assistant Examiner*—Gene P. Crosby
*Attorney, Agent, or Firm*—Cushman, Darby & Cushman

[57] ABSTRACT

A power impacting device includes two driving pistons, an inner piston, and an outer piston concentric with the inner piston. Pressurized fluid is supplied first to the outer piston and then to the inner piston to drive a two-piece fastener through material which it is to fasten together. The fastener includes an outer component which is driven by the outer piston, and an inner component which is driven by the inner piston to cam tip portions of the outer component radially outwardly to tightly hold two or more workpieces together. The fasteners may be automatically fed to the impacting device, and frangible links provided therewith for engaging riflings in the barrel of the impacting device to impart a rotational velocity component to the fasteners when they are driven. The impacting device is inoperative unless it is pressed into contact with the surface into which fasteners are to be driven and a handle safety mechanism is operated, and a loading gate allowing the feed of fasteners to the device is closed.

8 Claims, 11 Drawing Figures

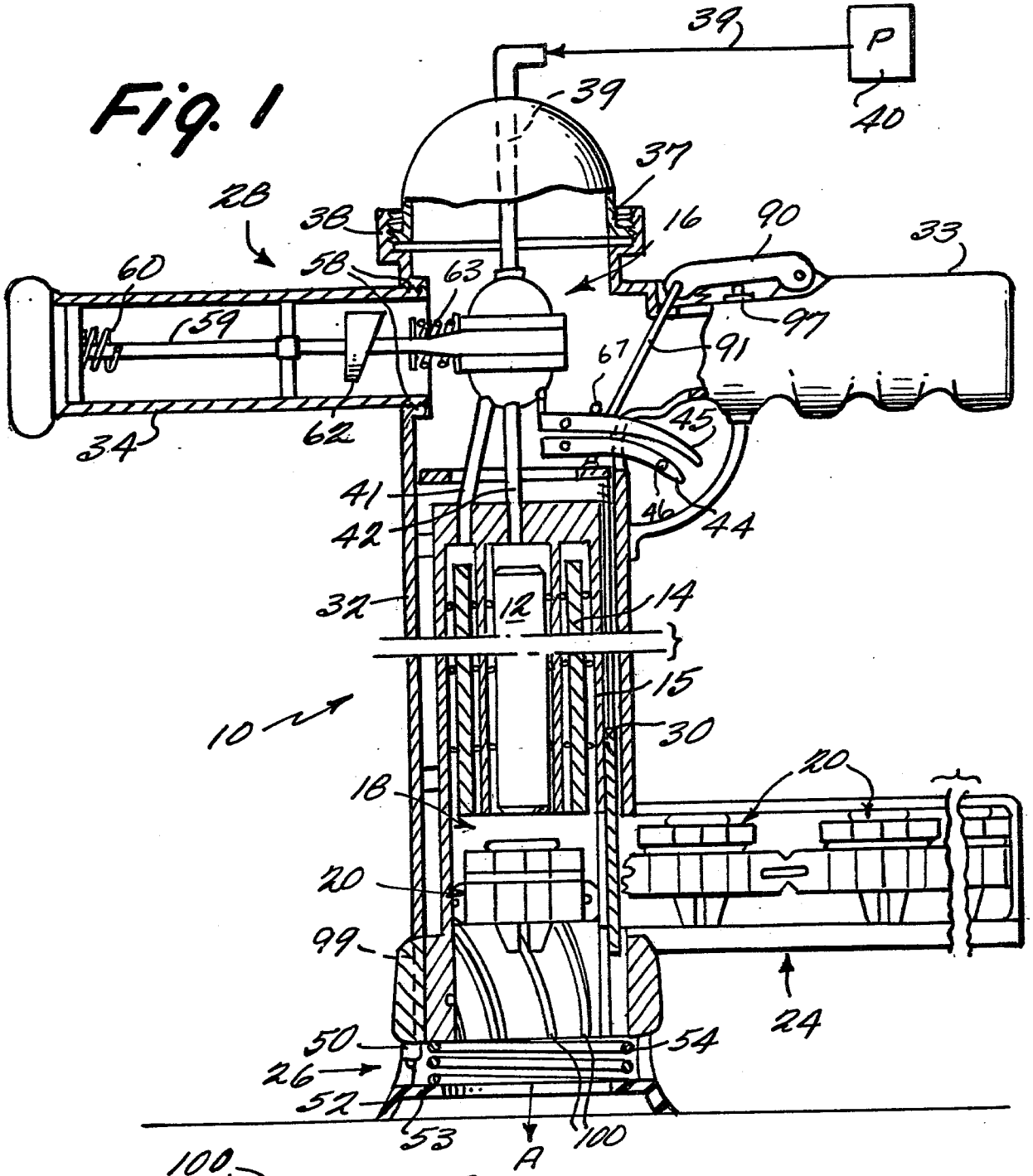
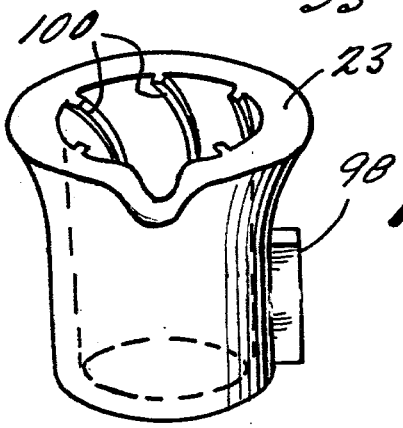
Fig. 9

TWO-PIECE FASTENER AIR HAMMER

BACKGROUND AND SUMMARY OF THE INVENTION

In the past there have been various proposals for blind fasteners including separately drivable inner and outer fastener components, such as shown in U.S. Pat. Nos. 1,587,317 and 3,691,924. While such fasteners can be very effective in holding two or more workpieces together, the usefulness of such fasteners is sometimes limited since it is not usually possible to provide for powered driving of the fasteners into place since two separate impacting forces must be applied to the separate fastener components. Where a powered driving means is utilized, first the outer component is driven through the workpieces, the tool removed, and then the inner component driven through the outer component to deform it into locking engagement with the workpieces, holding them together.

According to the present invention, a powered impacting device is provided that provides power driving of both the inner and outer fastener components of two piece blind fasteners without the necessity of first driving the outer component, then inserting the inner component, and then driving the inner component. Also, according to the present invention, particular two-piece fasteners and an assembly thereof are provided that allow for automatic feeding thereof to the impacting device, and which are capable of imparting a rotational component to the fasteners during firing to insure that the fasteners are driven in a true manner through the workpieces.

According to the powered impacting device of the present invention, a first, inner driving piston, and a second, outer, driving piston—concentric with the first piston—are provided. Means are provided for supplying actuating pressurized fluid to the second piston and then to the first piston to effect axial movement of each, in the same direction, and means are provided for receipt of a two-piece fastener—having concentric inner and outer components—in operative relationship with the pistons so that the outer component is driven by the second piston, and the inner component is driven by the first piston. The fastener receipt means includes a firing barrel, and a magazine or the like is provided for automatically feeding fasteners into the firing barrel for automatic firing thereof. The barrel may be rifled, and each fastener then includes at least one frangible plastic link associated therewith for engaging the barrel riflings to impart rotational movement to the fastener while it is being driven, but the plastic links disintegrate fully upon impaction of the fastener on a surface. A loading gate is provided for separating connected-automatically fed fasteners from each other, and for sealing off the firing barrel from the magazine during driving of the fasteners.

Various safety mechanisms are provided including means for preventing a supply of actuating pressurized fluid to either of the pistons unless the end of the impacting device out of which the fasteners are fired is in contact with the surface, unless a safety handle is positively rotated against spring pressure, and unless the loading gate is in closed position.

Each fastener outer component comprises a generally tubular member having two distinct tip portions forming a penetrating point thereof, and cam engaging interior portions. Each inner component comprises a cylindrical member having a pointed tip portion, and cam surface means for engaging the cam engaging interior portions of a cooperating outer component for camming the distinct tip portions of the outer component radially outwardly into fastening engagement with the workpieces. According to the invention an assembly of two-piece fasteners is provided, which fasteners are operatively connected together for automatic feeding thereof by frangible connector means. At least one frangible plastic link also is preferably associated with each fastener for engaging bore riflings in a firing barrel for the fasteners to thereby impart rotation to at least one component of each fastener during firing.

It is the primary object of the present invention to provide a system for the ready fastening of at least two workpieces together with two-piece linked fasteners. This and other objects of the invention will become clear from an inspection of the detailed description of the invention, and from the appended claims.

BRIEF DESCRIPTION OF THE DRAWINGS

FIG. 1 is a schematic view, partly in cross-section and partly in elevation, showing an exemplary powered impacting device according to the invention;

FIG. 9 is a perspective view of an exemplary replaceable firing barrel utilizable with the device of FIG. 1.

DETAILED DESCRIPTION OF THE INVENTION

Figure 2:
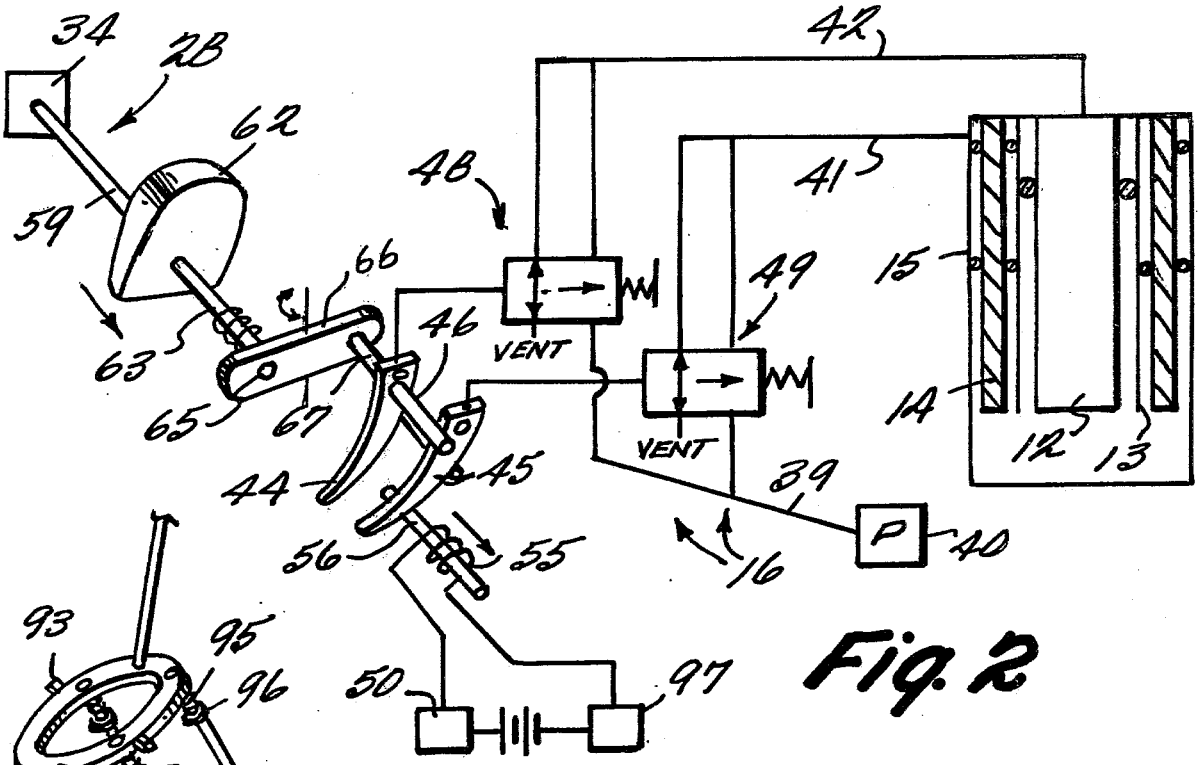
FIG. 2 is a diagrammatic showing of component parts of the impacting device of FIG. 1 for supply pressurized actuating fluid to the device.

An exemplary powered impacting device according to the present invention is shown schematically at 10 in FIG. 1. The primary operative components of the device 10 include a first, inner driving piston 12 (shown in elevation in FIG. 1) reciprocal in an inner cylinder 13, and a second, outer driving piston 14 concentric with the first piston 12 and reciprocal in an outer cylinder 15 concentric with the inner cylinder 13. Means 16 (see FIG. 2 in particular) are provided for supplying actuating pressurized fluid to said pistons 12, 14 so that the outer piston 14 is driven axially in direction A first, and then the inner piston 12 is driven in direction A with respect to piston 14, means 16 supplying fluid to the second piston 14 and then to the first piston 12 to effect axial movement of each in direction A. Means—shown generally at 18 in FIG. 1—are provided for receipt of a two-piece fastener 20 having concentric inner 21 and outer 22 (see FIGS. 5 and 8 in particular) components, in operative relationship with the pistons 12, 14 so that the outer component 22 is driven by the second piston 14, and the inner component 21 is driven by the first piston 12.

Figure 3:
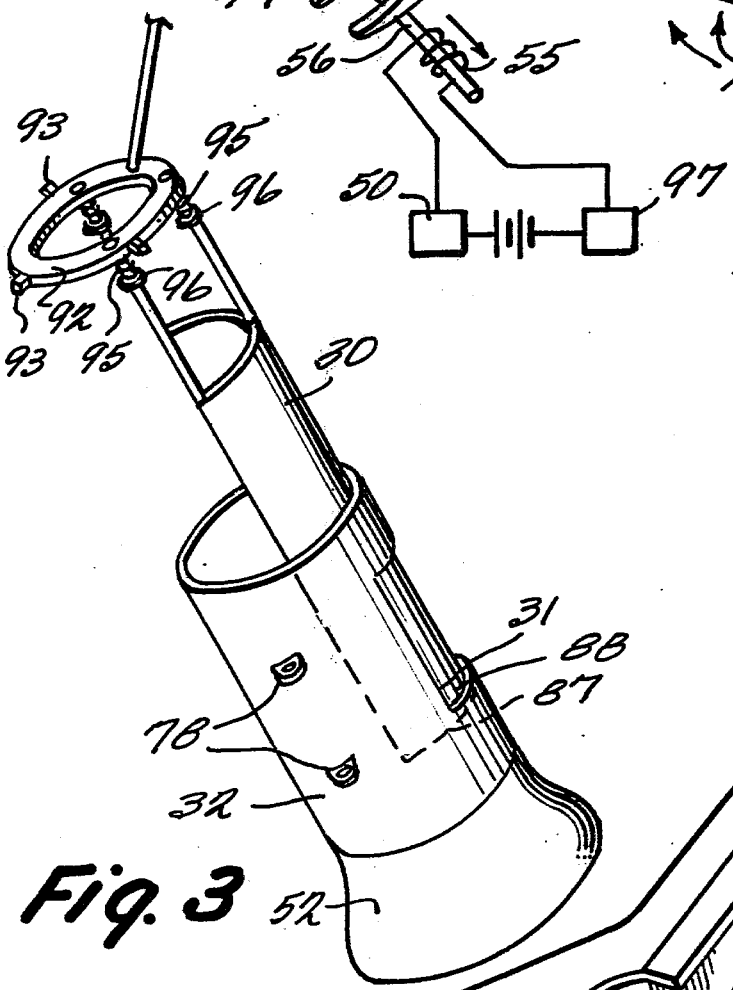
FIG. 3 is a schematic perspective view, with portions cut away, illustrating the front end of the device of FIG. 1 and showing a loading gate therefor in detail.

The fastener receipt means 18 includes a firing barrel 23, and means 24—such as a magazine as shown in the drawings—are provided for automatically feeding fasteners 20 into the firing barrel 23 for automatic firing thereof. Safety means 26 are provided for preventing supply of actuating pressurized fluid to either of the pistons unless the device is in contact with the surface into which the fasteners are to be driven, and a handle safety mchanism 28 is provided that requires positive manual operation thereof before actuating fluid can be supplied to either piston. A loading gate 30 is provided for selectively blocking or opening a passage 31 (see FIG. 3) allowing entry of fasteners from the automatic feeding means 24 to the barrel 23.

The device 10 preferably includes a body portion 32 and first and second handles 33, 34 for gripping by the operator of the device 10 during utilization thereof. The body portion 34 supports the inner and outer cylinders 13, 15, the inner cylinder 13 being operatively connected to the outer cylinder 15 (as by spider arms received by slots in the outer piston 14). Any suitable arrangement of concentric inner and outer pistons capable of driving two-piece fasteners may be provided. A cap 36 having screw threads 37 formed thereon is engageable with a threaded collar 38 formed at the top of the body 32, the cap 36 having a hose 39 extending therethrough and connected up to a source of high pressure actuating fluid 40 located exteriorly of the device 10. The source 40 can be any suitable source for actuating the pistons 12, 14, and preferably comprises a pneumatic compressor. High pressure fluid from line 39 is fed through line 41 to the top of cylinder 15 above piston 14, and fluid passes through line 42 to the top of cylinder 13 above piston 12.

The means 16 for supplying actuating pressurized fluid to the second piston 14 and then to the first piston 12 may include any suitable conventional structure such as a diaphragm mechanism, valves, or the like. One form that the means 16 may take is shown most clearly in FIGS. 1 and 2, and includes first and second triggers 44 and 45 respectively, operatively associated with the first handle 33, the first trigger 44 for effecting supply of fluid to the first piston 12, and the second trigger 45 for effecting supply of actuating fluid to the second piston 14. A pin 46 may extend from first trigger 44 to second trigger 45 for making abutting engagement with the second trigger 45 to provide means for operatively connecting the triggers 45, 44 so that the first trigger 44 cannot be actuated to supply fluid to the first piston 12 until the second trigger 45 has been actuated to supply fluid to the second piston 14. Other suitable connections or pneumatic or electrical controls may be provided to ensure that once trigger 45 has been pulled, actuating fluid cannot again be supplied to outer piston 14 until trigger 44 is pulled.

As shown in FIG. 2, trigger 44 may be connected to a first valve means 48, and trigger 45 connected to a second valve means 49, the first valve means 48 for either venting line 42 to atmosphere (the normal position into which it is spring biased) or connecting line 39 to line 42, and the second valve means 49 either venting line 41 to atmosphere (the normal position) or connecting line 41 to line 39.

Various safety mechanisms may be provided for preventing supply of fluid to the piston 12, 14, such as means 26 and 28. The safety means 26 may include a microswitch 50 that is depressed only when the blow shield 52 of the device 10 is pressed into solid contact with a surface through which the fasteners 20 are to be driven. The blow shield 52 preferably is formed of flexible material, and has a ring actuating portion 53 thereof spring biased by coil spring 54 or the like into a downward position. When the blow shield 52 is pressed against the workpiece, the ring 53 moves against the biasing spring 54 and depresses microswitch 50. Microswitch 50 in turn may either control a solenoid actuated valve in line 39, or may control a solenoid 55 (see FIG. 2) for moving a locking pin 56 out of locking engagement with trigger 45 when microswitch 50 is actuated.

The safety mechanism 28 is associated with second handle 34, and may comprise a wide variety of means that require positive actuation by the operator on handle 34 before fluid may be supplied from line 39 to the pistons 12, 14. A preferred form of the safety mechanism 28 is illustrated in FIGS. 1 and 2. The handle 34 is mounted by bushings 58 for rotation with respect to body portion 32, and a shaft 59 is connected to handle 34 for rotation therewith against the bias of torsion spring 60 or the like. At one end of the shaft 59 a cam 62 is provided, a cam follower rod 63 being spring biased into engagement with the cam surface of cam 62. Rotation of cam 62 imparts a linear movement to the rod 63, which in turn may control a valve in line 39 that allows passage of fluid from source 40 to lines 41 and 42, or—as shown in FIG. 2—may control movement of a blocking arm out of blocking engagement with the triggers 44, 45. As shown in FIG. 2, the end of spring pressed reciprocal rod 63 opposite its point of engagement with cam 62 is pivotally mounted at 65 to a disc 66 that is rotatable about an axis perpendicular to the axis about which triggers 44 and 45 are pivoted. A blocking element 67 is also pivotally mounted to the disc 66, so that upon movement of rod 63 in direction B (see FIG. 2) as a result of rotation of cam 62, the element 67 will be pivoted out of blocking engagement with the triggers 44 and 45, allowing actuation thereof.

Figure 4:
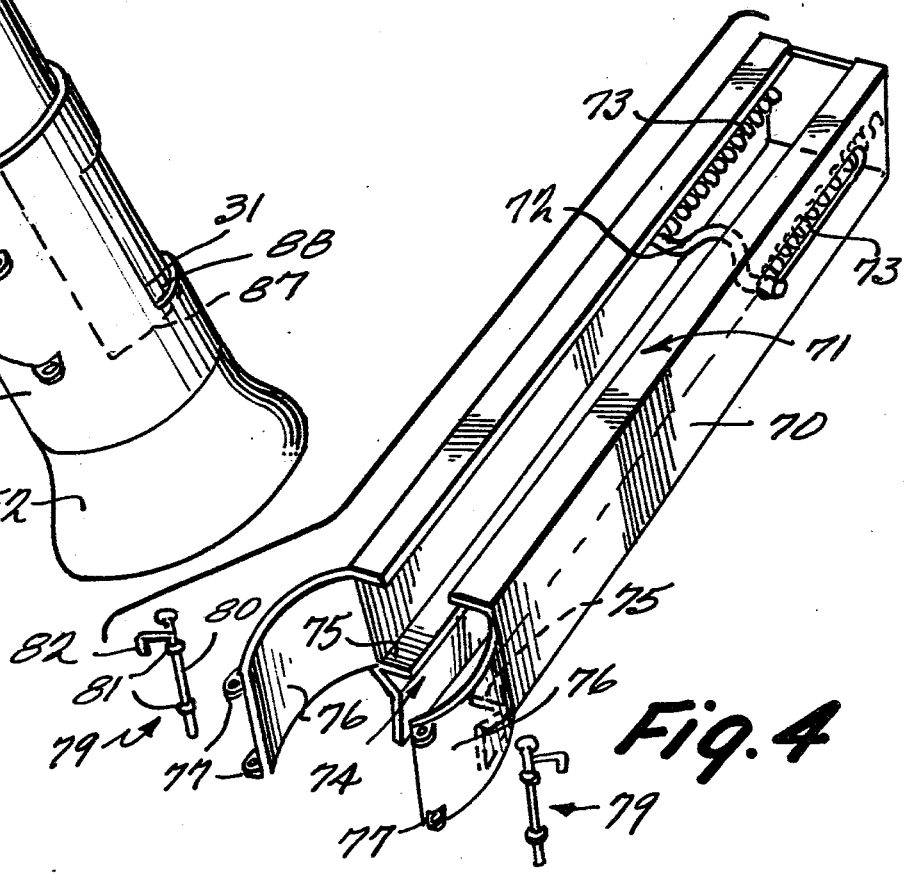
FIG. 4 is a perspective view of an exemplary magazine utilizable in the device of FIG. 1.

The magazine 24 for feeding fasteners 20 automatically one at a time into the receiving chamber 18 of device 10, is shown most clearly in FIGS. 1 and 4. The magazine 24 includes a body portion 70 with a generally open top 71, and a rod 72 biased by compression spring 73 to push fasteners 20 contained within the magazine 24 out of the open front end 74 thereof. A desirable arrangement for the magazine 24 includes longitudinally extending support ridges 75 formed therein for engaging and vertically supporting selected portions of the fasteners 20 so that fasteners 20 slide with rod 72 under the bias of spring 73 out of the open front 74 of the magazine 24, through opening 31, past the load gate 30 (when open) and into the chamber 18. The magazine 24 may be connected to the body portion 32 of the device 10 by arcuate portion 76 which partially wrap around the exterior of the body portion 32 in the vicinity of opening 31. Eyelets 77 are formed at the termination of either arcuate member 76, and the eyelets cooperate with similar eyelets 78 formed on the body 32 on either side of opening 31. Quick release spring clips 79 are provided to hold the eyelets 77, 78 together, the shank 80 of each clip 79—with detent formations 81 thereon—passing through cooperating eyelets 77, 78 to hold them together. Arm 82 may be manually engaged for effecting movement of the shank 80 out of engagement with the eyelets 77, 78. After release of the spring clip 79, the magazine 24 may either be replaced or reloaded.

Figure 7:
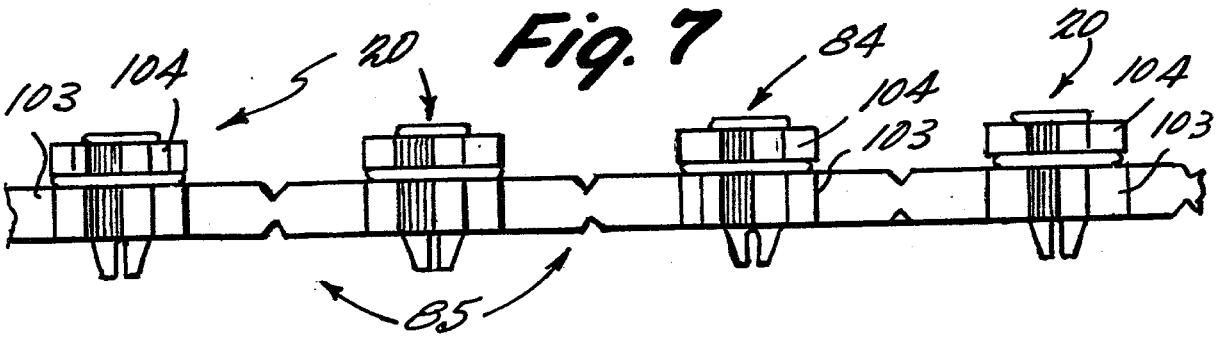
FIG. 7 is a side schematic showing an assembly of fasteners utilizable according to the present invention.

An assembly of two-piece fasteners 20 that are operatively connected together for automatic feeding thereof by magazine 24 is illustrated in FIG. 7. The assembly 84 of FIG. 7 includes frangible connector means 85 for operatively connecting consecutive fasteners 20 together. The connector means 85 may include a chain of plastic components having grooves 86 formed therein at midpoints between consecutive fasteners 20. When the fasteners 20 are fed into the chamber 18, and the gate means 30 is moved to block the passageway 31—sealing off the chamber 18—edge means 87 on the gate 30 cooperate with edge means 88 of the body 32 to fracture the connectors 85 along grooves 86. The connectors 85 are formed of frangible plastic or the like so that upon firing of the fasteners 20 out of barrel 23, the connectors 25 disintegrate upon impact with the work surface.

The gate 30 may be raised to passage-31 unblocking position, or lowered to passage-31 blocking position, by any suitable manual or powered means. One such suitable arrangement is shown schematically in FIGS. 1 and 3, and includes a manually operated lever 90 pivotally mounted to first handle 33. The lever 90 is connected by link 91 to reciprocal plate 92. Flanges 93 may be formed on plate 92 for cooperating with cooperating grooves (not shown) within the interior of body 32 for guiding reciprocal movement of the plate 92 in direction A, and opposite to direction A. One or more rods 94 operatively connect the plate 92 to loading gate 30 so that reciprocal movement of the plate 92 results in reciprocal movement of gate 30. Plate 92 preferably is biased to the closed position (FIGS. 1 and 3) by suitable biasing means, such as a plurality of tension springs 95, one disposed around each rod 94 and operatively connected to plate 92 and a support 96 stationary with respect to body 32. If desired, a microswitch 97 or the like may be provided for actuation by lever 90, it being necessary that lever 90 be in the down position—and thus loading gate 30 closed—before it is depressed, depression of the actuator for the microswitch 97 being necessary before a circuit can be completed through solenoid 55 for moving blocking pin 56 out of locking engagement with trigger 45. Additionally, a latching means may be provided for latching the leading edge 87 of gate 30 in closed position.

The firing barrel 23 (shown most clearly in FIGS. 1 and 9) preferably is readily replaceable, a key 98 being formed exterior thereof for cooperation with a corresponding keyway 99 formed in the bottom portion of body 32, with releasable fastening means provided between body 32 and key 98. Additionally, the barrel 23 also preferably is rifled—see rifling grooves 100—so that an angular velocity component is imparted to at least one of the fastener components 21, 22 to ensure that fastener components are driven through. Alternatively, guide grooves may be provided in the barrel 23 for guiding straight line movement of the fastener components.

When riflings 100 are provided in the bore 23, and rifling is desired, means must be provided associated with fasteners 20 for engaging the barrel riflings 100 so that angular velocity is imparted to the fasteners during axial movement thereof. Such riflings engaging means may comprise at least one frangible link 102 associated with each fastener 20. For instance—as shown most clearly in FIGS. 5-7-two frangible links 103, 104 are provided, having surface means 106 formed thereon for engaging riflings 100. The link 104 cooperating with inner fastener component 21 will preferably not have surface means 106 disposed around the entire periphery thereof; otherwise it might interfere with the movement of piston 14 impacting on outer component 22. The impacting surface of outer piston 14 may be shaped so that it does not engage surface means 106 of link 104. The links 103, 104 are constructed of suitable frangible plastic or the like so that they disintegrate upon impact on the surface through which the fastener 20 associated therewith is driven. When links 103 are provided, they may be directly connected to connectors 85 between consecutive fasteners 20.

Figure 5:
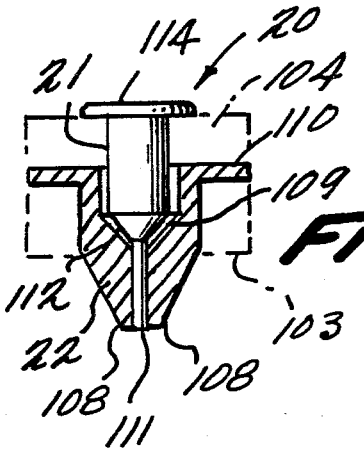
FIG. 5 is a cross-sectional view of an examplary two-piece fastener utilizable according to the present invention.
Figure 6:
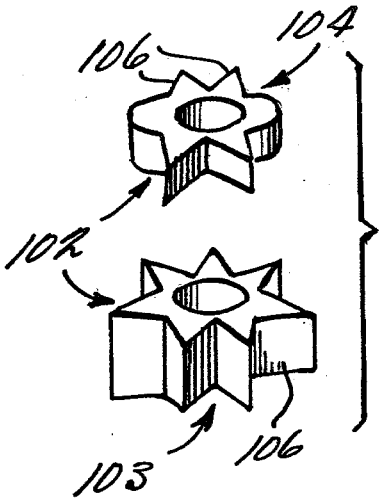
FIG. 6 is a perspective view of exemplary frangible plastic links utilizable with the fastener of FIG. 5.
Figures 8A, 8B, 8C:
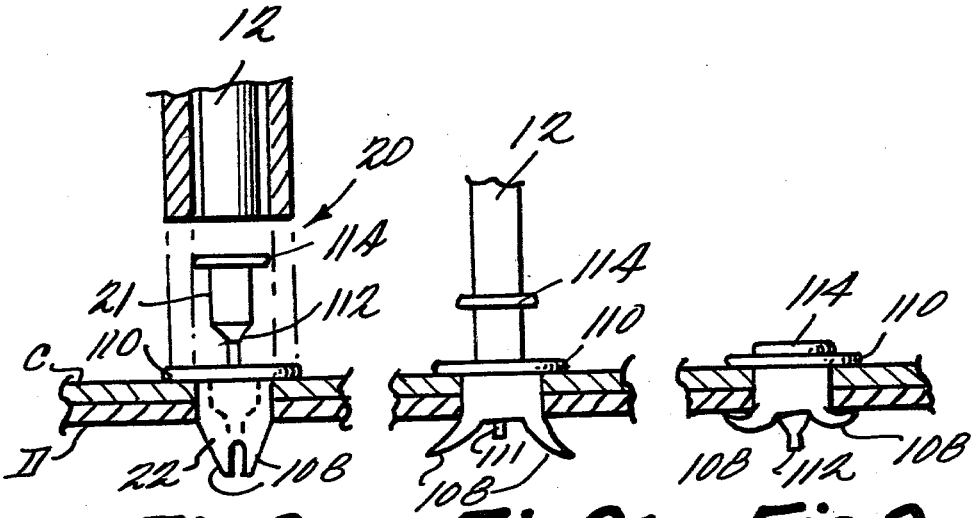
FIGS. 8*a* through 8*c* are schematic showings of successive steps for utilizing the fastener of FIG. 5 to fasten workpieces together.

A wide variety of two-piece fasteners may be utilized as the fasteners 20 according to the present invention, such as those illustrated in U.S. Pat. Nos. 1,587,317 and 3,691,924. A preferred fastener according to the invention is shown in FIGS. 5 and 8, the fastener 20 having an outer component 22 formed as a generally tubular member having two distinct tip portions 108 thereof forming a penetrating point, and cam-engaging interior portions 109 thereof. A ring-like head 110 is provided for engaging the top of two material sheets to be fastened together. The inner component 21 comprises a cylindrical member having a pointed tip portion 111, and cam surface means 112 for engaging the cam engaging interior portions 109 of a cooperating outer component 22 for camming the distinct tip portions 108 radially outwardly with respect to the inner component 21. Use of fasteners 20 according to the invention to fasten together two worksheets (i.e. two pieces of sheet metal) C and D is shown in FIGS. 8*a*–8*c*. In FIG. 8*a*, the outer piston 14 has impacted against the head 110 of the outer fastener 22 and has driven the tip portions 108 of the outer component 22 through both the sheets C and D. The head 114 of the inner component 21 has not as yet been impacted by the inner piston 12. FIG. 8*b* shows the fastener inner component 21 midway through the driving thereof through the sheets C, D by the inner piston 12, the cam portions 112 of component 21 engaging the cam engaging portions 109 of outer component 22 to begin to move the tip portions 108 radially outwardly. FIG. 8*c* shows the fastener after complete penetration of the sheets C, D by the inner component 21, the head 114 of inner component 21 solidly abutting the head 110 of the outer component 22, and the camming portions 112 of component 21 having completely radially outwardly moved the tip portions 108 of component 22 into holding engagement with the bottom of sheet D, sheets C and D thus being sandwiched together between head 110 and tips 108.

While the utilization of the fasteners according to the invention has been described with respect to the fastening of two pieces of sheet metal together, it is understood that suitable fasteners 20 may be constructed for fastening together a wide variety of compositions of workpieces, such as two or more pieces of wood, two or more pieces of other sheet material, or the like. The fastener 20 components 21, 22 preferably are constructed of relatively hard metal, or other strong malleable material. Thus, it will be seen that according to the present invention, a powered impacting device has been provided which effects automatic driving of both the inner and outer components of two-piece fasteners through worksheets to be fastened together without interruption in the driving operation, and provides a number of features for the automatic feed of the fasteners, through driving of the fasteners, and safe operation of the device. Also, according to the present invention, an assembly of two-piece fasteners for fastening two worksheets together in a "blind" manner has been provided. Thus, the objects of the present invention have been accomplished.

While the invention has been herein shown and described in what is presently conceived to be the most practical and preferred embodiment thereof, it will be apparent to those of ordinary skill in the art that many modifications may be made thereof within the scope of the invention. For instance, fasteners may be fed individually into the chamber 18, and not connected together by frangible connectors, and suitable other means may be provided for holding the fasteners within chamber 18 for consecutive impaction (such as guide flanges on the inner and outer components 21, 22, or a magnetized end of first piston 12 for magnetically attracting inner component 21). Many other modifications are also possible, therefore the invention is to be accorded the broadest scope of the appended claims so as to encompass all equivalent structures and assemblies.

What is claimed is:

1. A powered impacting device comprising:

a first, inner, piston;

a second, outer, piston concentric with said first piston;

means for receipt of two-piece fastener, having concentric inner and outer components, in operative relationship with said pistons so that said outer component is driven by said second piston, and said inner component is driven by said first piston, said means including a firing barrel;

means for supplying pressurized fluid to said pistons so that said second piston contacts said outer component and drives it axially in a given direction, and then said first piston contacts said inner component and drives it axially in the same direction, moving relative to said second piston, and causes said fastener outer component to pierce a workpiece and said fastener inner component to cam said outer component into locking engagement with the workpiece; and means for automatically feeding fasteners into said firing barrel for firing thereof, out of said barrel.

2. A device as recited in claim 1 wherein said firing barrel is rifled, so that an angular velocity is imparted to each fastener during axial movement thereof.

3. A device as recited in claim 1 wherein said automatic feeding means comprises a magazine having biasing means for feeding fasteners one after the other into said firing barrel.

4. A device as recited in claim 1 wherein said means for supplying pressurized fluid to said pistons comprises means for supplying fluid to said second piston first, and then for supplying fluid to said first piston, said means further comprising first and second triggers operatively associated with said first handle, said first trigger for effecting supply of fluid to said first piston and said second trigger for effecting supply of fluid to said second piston, and means connecting said triggers so that said first trigger cannot be actuated to supply fluid to said first piston until said second trigger has been actuated to supply fluid to said second piston.

5. A device as recited in claim 1 wherein said means for supplying pressurized fluid to said pistons comprises means for supplying fluid to said second piston first, and then for supplying fluid to said first piston, and further comprising safety means for preventing supply of actuating pressurized fluid to either of said pistons unless said device is in contact with a surface into which said fasteners are to be driven.

6. A powered impacting device comprising:

a first, inner, piston; a second, outer, piston concentric with said first piston; means for receipt of a two-piece fastener, having concentric inner and outer components, in operative relationship with said pistons so that said outer component is driven by said second piston, and said inner component is driven by said first piston; and means for supplying pressurized fluid to said pistons so that said second piston contacts said outer component and drives it axially in a given direction, and then said first piston contacts said inner component and drives it axially in the same direction, moving relative to said second piston; wherein the improvement comprises said means for supplying pressurized fluid to said pistons comprising means for supply fluid to said second piston fluid, and then for supplying fluid to said first piston, to first drive the outer fastener component to self-pierce a workpiece, and then to drive the inner fastener component to deform the outer component into locking relationship with the workpiece; said means further comprising first and second triggers operatively associated with a first handle for the device and first trigger for effecting supply of fluid to said first piston and said second trigger for effecting supply of fluid to said second piston, and means connecting said triggers so that said first trigger cannot be actuated to supply fluid to said first piston until said second trigger has been actuated to supply fluid to said second piston.

7. A device as recited in claim 6 further comprising a second handle for said device, said second handle having safety means associated therewith for selectively blocking or unblocking movement of said triggers.

8. A powered impacting device comprising:

a first, inner, piston; a second, outer, piston concentric with said first piston; means for receipt of a two-piece fastener, having concentric inner and outer components, in operative relationship with said pistons so that said outer component is driven by said second piston, and said inner component is driven by said first piston; and means for supplying pressurized fluid to said pistons so that said second piston contacts said outer component and drives it axially in a given direction, and then said first piston contacts said inner component and drives it axially in the same direction, moving relative to said second piston; wherein the improvement comprises safety means for preventing supply of actuating pressurized fluid to said pistons unless said device is in contact with a surface into which said fasteners are to be driven.

* * * * *